US006945186B2

(12) United States Patent
Lehmann

(10) Patent No.: US 6,945,186 B2
(45) Date of Patent: Sep. 20, 2005

(54) RUDDER WITH SLIDING PIVOTING PISTON COUPLING

(75) Inventor: Dirk Lehmann, Winsen (DE)

(73) Assignee: becker marine systems GmbH & Co. KG, Hamburg (DE)

( * ) Notice: Subject to any disclaimer, the term of this patent is extended or adjusted under 35 U.S.C. 154(b) by 0 days.

(21) Appl. No.: 10/493,813

(22) PCT Filed: Oct. 25, 2002

(86) PCT No.: PCT/EP02/11933

§ 371 (c)(1),
(2), (4) Date: Aug. 30, 2004

(87) PCT Pub. No.: WO03/043882

PCT Pub. Date: May 30, 2003

(65) Prior Publication Data

US 2005/0000402 A1 Jan. 6, 2005

(30) Foreign Application Priority Data

Nov. 20, 2001 (DE) ..... 201 18 779

(51) Int. Cl.[7] ..... B63H 25/06
(52) U.S. Cl. ..... 114/162; 114/169
(58) Field of Search ..... 114/162, 169

(56) References Cited

U.S. PATENT DOCUMENTS 4,310,319 A * 1/1982 Fuller ..... 440/51
4,448,146 A * 5/1984 Becker ..... 114/162

FOREIGN PATENT DOCUMENTS

| | | |
|---|---|---|
| DE | 2353934 | 7/1974 |
| EP | 0051822 | 5/1982 |
| EP | 0811552 | 12/1997 |
| FR | 1382764 | 2/1964 |
| GB | 2206324 | 1/1989 |
| GB | 2248049 | 3/1992 |

* cited by examiner

*Primary Examiner*—Stephen Avila
(74) *Attorney, Agent, or Firm*—Friedrich Kueffner

(57) ABSTRACT

The invention relates to a rudder for sea vessels, consisting of a main rudder and a fin which is coupled thereto by means of a vertical piston (15), restrictively guided by the main rudder and provided with a horizontal piston (11) The vertical piston (15) and the horizontal piston (11) are connected to each other via a hinge bolt to form a sliding pivoting piston coupling (100) and a bearing housing (16) of the vertical piston (15) is fixed to the hull of the vessel. In order to reduce the forces acting upon the sliding bearing of the vertical coupling bolt and horizontal pivoting bolt in addition to the hinge bolts connecting said bolts, the vertical piston (15) is supported by an additional counter bearing (27) on the hull of the vessel.

9 Claims, 2 Drawing Sheets

RUDDER WITH SLIDING PIVOTING PISTON COUPLING

FIELD OF APPLICATION

This invention relates to a rudder for seagoing vessels consisting of a main rudder and a forced guided fin with a sliding swivel piston articulation consisting of a horizontal piston and a vertical piston which are connected with each other over an universal joint by means of a hinged bolt with the characteristics indicated in the preamble of claim 1.

PRIOR ART

A ship rudder construction of the above mentioned type is known by DE-A-23 53 934 with a propeller at least partially provided with a casing with an auxiliary rudder, articulated on the rear edge of the main rudder, which is connected with an operating mechanism which contains a driving rod movable in a guide bush and which is rotatably connected with the hull in a surface plane approximately vertical to the axis about a pivot situated behind this surface plane.

For this ship rudder construction, the guide bush is placed on the auxiliary rudder approximately horizontally and practically parallel to the rudder face, while the driving rod is positioned rotatable on an axis placed behind the rudder axis and has such a length that the cooperation between the driving rod and the guide bush works for a rudder steering lock of 90°.

The guiding and positioning of the driving rod positioned at one end on the hull for steering the fin takes place by means of the guide bush which is fixed to the fin horizontally in the upper area of the fin and through which the driving rod passes. The guide bush as a sliding bearing shows a slide packing in its inner space.

The driving rod is positioned in a practically horizontal surface plane rotatable on an axle muff (articulation bolt) which engages into an axle muff casing and which is locked at its free end by a locking bolt.

The EP 0 051 822 describes a further development of the DE 23 53 934. This ship rudder construction consists of a main rudder with an articulated and forced guided fin. The forced guided fin is configured with a sliding bearing for the swivel pin articulated at the one end on the hull.

The main rudder and the forced guided fin articulated on the main rudder are provided with a sliding swivel piston articulation made of a sliding bearing configured on the fin for a swivel piston. An articulation bolt fixed with its projecting end on an articulation bolt fixed on the hull is thus positioned swivellable.

In the patent document EP 0 811 552 which develops further the EP 0 051 822, the articulation bolt as sliding bearing is additionally designed as a piston for avoiding undesired high edge pressures as well onto the vertical articulation bolt as on the horizontal swivel pin and onto the bolt connecting sliding swivel piston articulation.

Through this measure, degrees of freedom are created for the rudder or its movable parts which guarantee that no bearing surface is charged stronger than necessary by the effect of high charged edges.

This configuration allows movements which are obtained by the use of a hinged bolt between both pistons guided in cases so that movements in an angle area of ±90° are possible, whereas the known systems are rigidly designed by the predetermined angle of 90°. Forces caused by a wall pressure onto the rudder and acting onto the system and arising bending moments will be compensated by the cylindrical piston configuration and jammings by the movable sliding swivel piston articulation.

However, the disadvantage is that the system of the sliding swivel piston articulation with the biggest possible degrees of freedom can only absorb forces which can be tolerated with respect to the wear behaviour of the sliding bearings of the articulation bolt or of the swivel pin and a hinged bolt which connects the bolts. In particular for ships with bigger rudder installations, the bigger forces acting onto the system are so big that a ship rudder construction according to the embodied known solutions can only be used under conditions or can no longer be used.

Aim, Solution, Advantage

The aim of this invention is to improve the rudder with the sliding swivel piston articulation in such a manner that the arising forces and developing bending moments can be taken up. However, all the parts can further be connected with each other in such a way that movements with sufficient degrees of freedom are kept up and that the existing functionality is not limited herewith.

The rudder for seagoing vessels with a sliding swivel piston articulation according to the invention with the characteristics indicated in claim 1 offers the advantage that the use of rudders with sliding swivel piston articulation is possible in bigger seagoing ships for which the arising forces are bigger than in the ships equipped until now.

Due to the fact that, for fixing the sliding swivel piston articulation on the hull, the vertical piston has at least one thrust bearing, the forces acting onto the sliding bearing of the vertical articulation bolt and of the horizontal swivel pin as well as onto the hinged bolt connecting the bolts are considerably minimized and the wear occurring is reduced to a tolerable extent.

In a preferred embodiment of the invention, the thrust bearing is connected with the hull with at least one horizontal cross bar over a vertical cross bar so that a part of the forces can be derived into the hull and the wished stability and wear reduction of the sliding swivel piston articulation can be reached.

Further preferred embodiments of the invention result from the characteristics indicated in the subclaims.

SHORT DESCRIPTION OF THE DRAWINGS

The invention will be explained below in more detail in an embodiment by referring to the attached drawings.

DETAILED DESCRIPTION OF THE INVENTION AND BEST WAY FOR CARRYING OUT THE INVENTION

Figure 1:
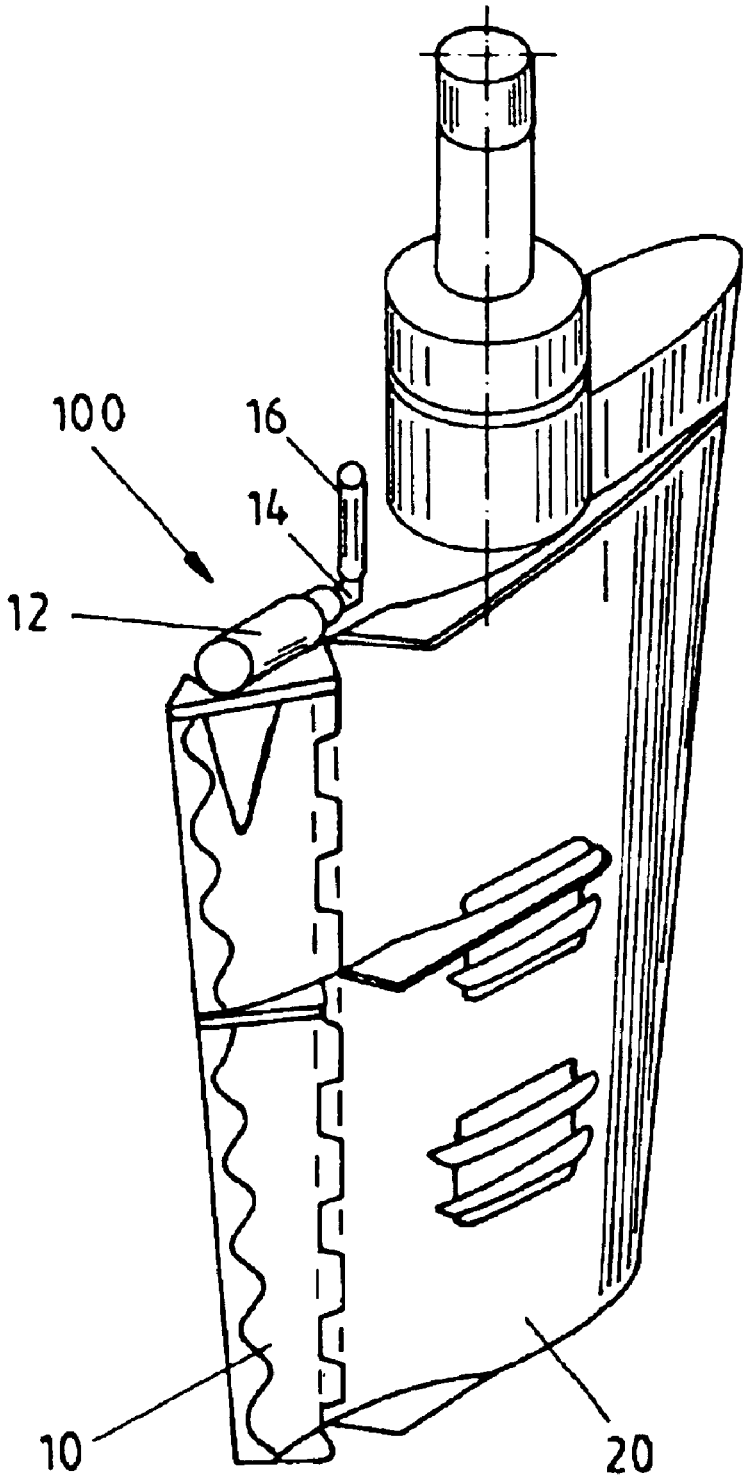
FIG. 1 shows a graphical view of a rudder with a fin and with a sliding swivel piston articulation.

A rudder represented in FIG. 1 consists of a main rudder 20 with a fin 10 which is placed swivellable on this main rudder and which is forced guided which is provided with a sliding swivel piston articulation 100. The sliding swivel piston articulation 100 essentially consists of an universal joint with a hinged bolt 14 and of the bearing housings 12 and 16 which can be seen on FIG. 1 of an associated horizontal piston 11 and of a vertical piston 15 which are represented together on FIG. 2.

Figure 2:
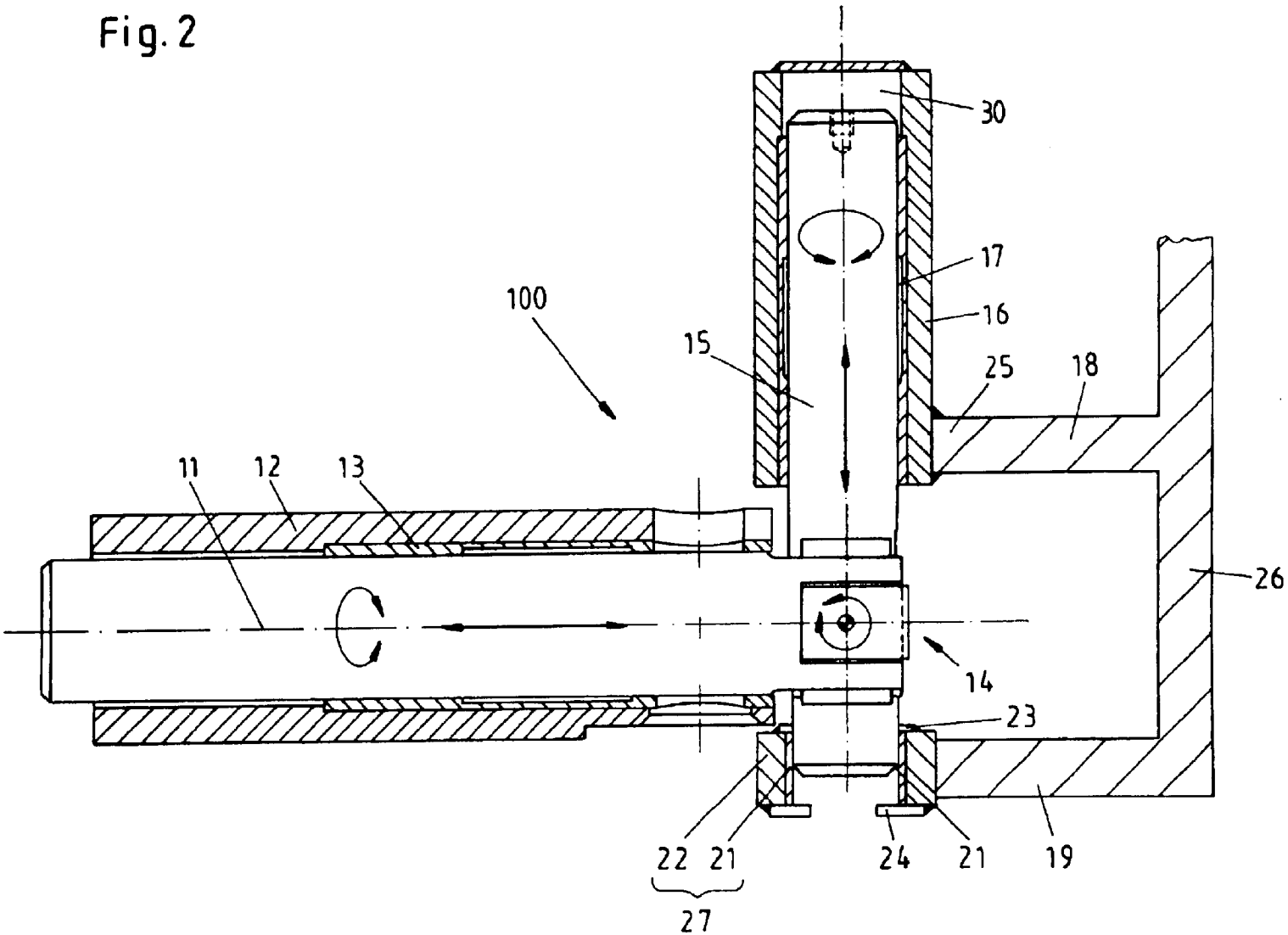
FIG. 2 shows a schematical view of the sliding pistons connected with each other of the sliding swivel piston articulation and of a thrust bearing.

FIG. 2 shows the components of the sliding swivel piston articulation 100. It consists, as already described, of the horizontal piston 11 and of the vertical piston 15. The horizontal piston 11, also designated as swivel pin, is placed movable in the bearing housing 12 and shows a bush 13 which is preferably made of bronze. The swivel pin 11 projecting out of the bearing housing 12 is movably connected with the vertical piston 15, also designated as articulation bolt, over a hinged bolt 14. The vertical piston 15 is placed movable in the bearing housing 16. The bearing housing 16 also has a bush 17 which is also preferably made of bronze. The hinged bolt 14 guarantees that even a variation of the horizontal piston from the 90° position can be compensated.

For damping piston strokes, i.e. for the vibration and oscillation damping, the bearing housing 16 of the vertical piston 15 is closed at its end turned to the hull and forms a pad 30 made of an absorbing substance above the vertical piston 15. The sealing of the bearing housing 16 constitutes simultaneously a stopper for the vertical movement of the vertical piston 15.

The sliding swivel piston articulation 100 is fixed on the fin 10 (FIG. 1) over the horizontal piston 11 situated in the bearing housing 12 for fulfilling its function while the vertical piston 15 has a thrust bearing 27 for the additional taking up of forces. The thrust bearing 27 (FIG. 2) is situated at the end of the vertical piston 15 which is opposite the hull. For reasons of clarity, the thrust bearing 28 is not represented in FIG. 1.

The thrust bearing 27 has a bush 21 and a bearing bush 22. The bush 21 constitutes a long wearing lining of the bearing bush 22. On the side of the thrust bearing 27 turned to the vertical piston 15, the bush 21 has a supporting ring 23 which serves for locking the bush 21.

A supporting ring 24 which additionally forms a further stopper for the vertical piston 15 is placed on the side of the thrust bearing 27 which is turned away from the vertical piston 15 for locking the bush 21.

The bush 21 is preferably made of bronze like the bushes 13 and 17 described above.

The thrust bearing 27 bears on a horizontal cross bar 19. The horizontal cross bar 19 is connected with a vertical cross bar 26 which is supported on the hull. Additionally, a further horizontal cross bar 18 which is fixed with a flange 25 on the thrust bearing 16 is situated in the area of the thrust bearing 16 of the vertical piston 15. The horizontal piston (stern bottom) 18 is also connected with the vertical cross bar (rudder port) 26 and thus supports the part of the vertical piston 15 on the hull which is situated above the hinged bolt 14.

Due to the construction described above, it is guaranteed that the forces acting onto the sliding swivel piston articulation 100 can be taken up by the thrust bearing 27 and by the flange 25 and can be introduced into the vertical cross bar 26 over the horizontal cross bars 18 and 19 and then into the hull.

An use of the rudder 20 with sliding swivel piston articulation 100 for bigger seagoing vessels is thus advantageously given.

What is claimed is:

1. Rudder for seagoing vessels consisting of a main rudder (20) and a fin (10) forced guided by the main rudder (20), articulated thereon over a vertical piston (15), fin which is provided with a horizontal piston (11), whereby the vertical piston (15) and the horizontal piston (11) are connected with each other over a hinged bolt (14) to a sliding swivel piston articulation (100) and a bearing housing (16) of the vertical piston (15) is fixed on a hull, wherein the vertical piston (15) is supported on the hull by an additional thrust bearing (27).

2. Rudder according to claim 1, wherein the thrust bearing (27) is placed on the side of the hinged bolt (14) which is opposite the vertical piston (15).

3. Rudder according to claim 1, wherein the thrust bearing (27) has a bearing bush (22) with a bush (21) into which an end of the vertical piston (15) projecting over the hinged bolt (14) penetrates.

4. Rudder according to claim 3, wherein the bush (21) has a supporting ring (23) on the side of the thrust bearing (27) turned to the vertical piston (15).

5. Rudder according to claim 3, wherein the bush (21) has a supporting ring (24) on the side of the thrust bearing (27) turned away from the vertical piston (15) which forms a movement stopper for the vertical piston (15).

6. Rudder according to claim 3, wherein the bush (21) is made of bronze.

7. Rudder according to claim 1, wherein the thrust bearing (27) is supported on the hull over a horizontal cross bar (19).

8. Rudder according to claim 7, wherein the horizontal cross bar (18) is connected with a vertical cross bar (26) which is supported on the hull.

9. Rudder according to claim 8, wherein the vertical cross bar (26) is connected over a further horizontal cross bar (19) with the bearing housing (16) of the vertical piston (15).

* * * * *